US010086428B2

(12) United States Patent
Fujioka et al.

(10) Patent No.: US 10,086,428 B2
(45) Date of Patent: Oct. 2, 2018

(54) CLAMPING DEVICE AND MOLDING APPARATUS

(71) Applicant: Toshiba Kikai Kabushiki Kaisha, Chiyoda-ku, Tokyo (JP)

(72) Inventors: Toshiharu Fujioka, Kanagawa-ken (JP); Kohei Watarai, Machida (JP); Saburo Noda, Atsugi (JP)

(73) Assignee: TOSHIBA KIKAI KABUSHIKI KAISHA, Chiyoda-Ku, Tokyo (JP)

( * ) Notice: Subject to any disclaimer, the term of this patent is extended or adjusted under 35 U.S.C. 154(b) by 31 days.

(21) Appl. No.: 14/757,494

(22) Filed: Dec. 23, 2015

(65) Prior Publication Data

US 2016/0184887 A1 Jun. 30, 2016

(30) Foreign Application Priority Data

Dec. 25, 2014 (JP) ..... 2014-262783

(51) Int. Cl.
*B22D 17/26* (2006.01)
*B22D 33/04* (2006.01)

(52) U.S. Cl.
CPC ..... *B22D 17/263* (2013.01); *B22D 33/04* (2013.01)

(58) Field of Classification Search
CPC ..... B22D 17/26; B22D 17/263; B22D 33/04
USPC ..... 164/341
See application file for complete search history.

(56) References Cited

U.S. PATENT DOCUMENTS 5,238,394 A * 8/1993 Hirata ..... B29C 45/6728 425/451.2
5,417,913 A 5/1995 Arend
2006/0263471 A1* 11/2006 Tsuji et al. ..... B29C 45/68 425/595
2007/0065534 A1* 3/2007 Tsuji et al. ..... B29C 45/6728 425/450.1
2007/0193712 A1* 8/2007 Mizota et al. ..... B22D 17/10 164/120

FOREIGN PATENT DOCUMENTS

JP S57-136562 8/1982
JP S61-175427 11/1986
JP H07-148807 6/1995
JP H09-070830 3/1997
JP 2006-015553 1/2006
JP 2007-331348 12/2007
(Continued)

OTHER PUBLICATIONS

English Language Abstract and English Language Translation of JP 2009-051090 published Mar. 12, 2009.
(Continued)

*Primary Examiner* — Kevin P Kerns
(74) *Attorney, Agent, or Firm* — DLA Piper LLP US

(57) ABSTRACT

The clamping device has a fixed platen, a moving platen which is movable in an mold opening and closing direction relative to the fixed platen, a tie bar which bridges the fixed platen and the moving platen, a pullout drive device which gives to the tie bar a driving force making the tie bar move to the back side of the fixed platen, and a support mechanism which is provided separately from the pullout drive device and support the load of the tie bar when moving the tie bar.

11 Claims, 8 Drawing Sheets

(56) References Cited

FOREIGN PATENT DOCUMENTS

| | | |
|---|---|---|
| JP | 2009-051090 | 3/2009 |
| JP | 2011-206807 | 10/2011 |

OTHER PUBLICATIONS

English Language Abstract and English Language Translation of JP 2007-331348 published Dec. 27, 2007.
English Language Abstract and English Language Translation of JP 2011-206807 published Oct. 20, 2011.
Japanese Office Action issued in JP 2014-262783 dated Jun. 5, 2018.

* cited by examiner

CLAMPING DEVICE AND MOLDING APPARATUS

TECHNICAL FIELD

The present invention relates to a clamping device and molding apparatus (molding machine) for opening and closing molds and clamping the mold. The molding apparatus is for example a die casting machine or injection molding machine.

BACKGROUND ART

Known in the art is a die casting machine which has pullout drive devices for pulling out tie bars from a fixed platen or moving platen (for example Patent Literature 1 and Patent Literature 2). By pulling out the tie bars, for example, exchange of molds can be facilitated. As such pullout drive devices, ones having various aspects have been proposed.

For example, as known pullout drive devices, there can be mentioned pullout cylinders (hydraulic cylinders) which are provided parallel to the tie bars (for example Patent Literature 1). Further, Patent Literature 2 discloses pullout drive devices constituted by devices which have rotary type electric motors and chains to which the rotation of the electric motors is transmitted. Patent Literature 3 discloses pullout drive devices constituted by devices which have rotary type electric motors, screw shafts which are arranged parallel to the tie bars and are rotated around their axes by the electric motors, nuts which are screwed with the screw shafts and move along the screw shafts by the rotation of the screw shafts around their axes, and coupling members which integrally connect the pullout drive devices and the tie bars.

CITATIONS LIST

Patent Literature

Patent Literature 1. Japanese Patent Publication No. 2009-51090A

Patent Literature 2. Japanese Patent Publication No. 2007-331348A

Patent Literature 3. Japanese Patent Publication No. 2011-206807A

SUMMARY OF INVENTION

Technical Problem

However, in Patent Literature 3, since the pullout drive devices and the tie bars are integrally connected, when pulling out the tie bars, the load of the tie bars was directly received by the pullout drive devices and therefore the screw shafts of the pullout drive devices were liable to end up being damaged. Further, for example, if tie bars are smoothly pulled out, in the exchange of molds etc., the work is facilitated and/or the work time is shortened. Accordingly, more preferably, a clamping device and molding apparatus capable of more suitably pulling out the tie bars are preferably provided.

Solution to Problem

A clamping device according to one aspect of the present invention has a fixed platen, a moving platen movable in an mold opening and closing direction relative to the fixed platen, a tie bar which bridges the fixed platen and the moving platen, a pullout drive device which gives to the tie bar a driving force which makes the tie bar move to a back side of one platen of the fixed platen and the moving platen, and a support mechanism which is provided separately from the pullout drive device and supports the load of the tie bar when making the tie bar move.

Preferably, the support mechanism has a suspension member which is provided separately from the pullout drive device and extends above the tie bar to the back side of the one platen, and a movable part which is suspended from the suspension member so as to be movable in the mold opening and closing direction and suspends the tie bar at the back side of the one platen.

Preferably, the one platen is the fixed platen, and the suspension member is supported upon the fixed platen.

Preferably, the pullout drive device gives a driving force in the mold opening and closing direction to a position of the movable part, the position being between the suspension member and the tie bar in an up-down direction.

Preferably, the pullout drive device has a screw shaft which is parallel to the suspension member, the movable part having a female screw part which is screwed with the screw shaft, and a driving unit which generates a driving force making the screw shaft rotate about its axis.

Preferably, in the clamping device, the movable part has a connecting device which can be selectively connected with respect to one, the other, and both of the two tie bars.

Preferably, the movable part has a body member which is connected to the tie bar and a rolling member which is pivotally supported by the body member to be able to roll in the mold opening and closing direction on the upper surface of the suspension member.

Preferably, the movable part is connected to the tie bar to be able to allow inclination of the tie bar relative to the horizontal direction.

Preferably, the movable part is connected to the tie bar to be able to allow rotation of the tie bar about its axis.

Preferably, the clamping device further has a split nut device which is provided at the other platen of the fixed platen and the moving platen and can mesh with an engaged part provided at the tie bar, and a scraper which can abut against the engaged part.

Preferably, the clamping device further has a split nut device which is provided at the other platen of the fixed platen and the moving platen and can mesh with an engaged part provided at the tie bar and has a nozzle which can spray gas toward the engaged part.

Preferably, the clamping device further has a display device and a control device for controlling the pullout drive device and the display device. The control device controls the display device so as to display an abnormality in a predetermined manner at least at one of a time when the pullout or insertion of the tie bar does not end within a predetermined time and a time when the load of the pullout drive device exceeds a predetermined threshold value at the time of pullout or insertion of the tie bar.

A molding, apparatus according to one aspect of the present invention is provided with the above clamping device.

Advantageous Effects of Invention

According to the present invention, a tie bar can be suitably pulled out.

DESCRIPTION OF EMBODIMENTS

Below, embodiments of the present invention will be explained with reference to the drawings. Note that, in the second embodiment on, configurations the same as or similar to the configurations in the already explained embodiments are assigned the same reference notations as the reference notations assigned to the configurations of the already explained embodiments and explanations will be sometimes omitted. Further, in the second embodiments on, when configurations corresponding (similar) to the configurations of the already explained embodiments are assigned reference notations different from the reference notations attached to the configurations of the already explained embodiments, the matters which are not particularly noted are similar the configurations of the already explained embodiments.

<First Embodiment>

Configuration of Die Casting Machine

Figure 1:
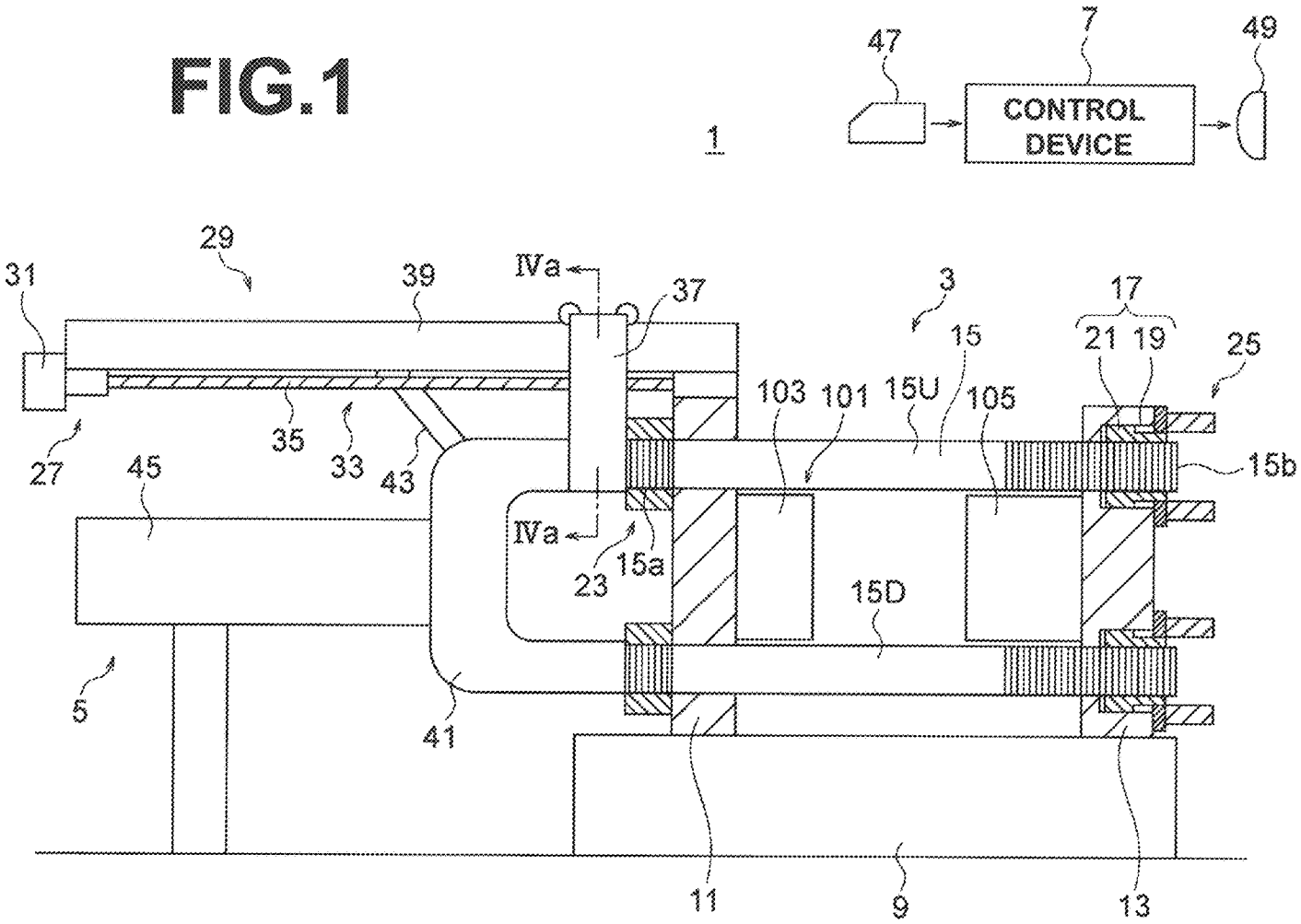
FIG. 1 is a schematic view showing the configuration of principal parts of a die casting machine according to a first embodiment of the present invention in a mold open state.
Figure 2:
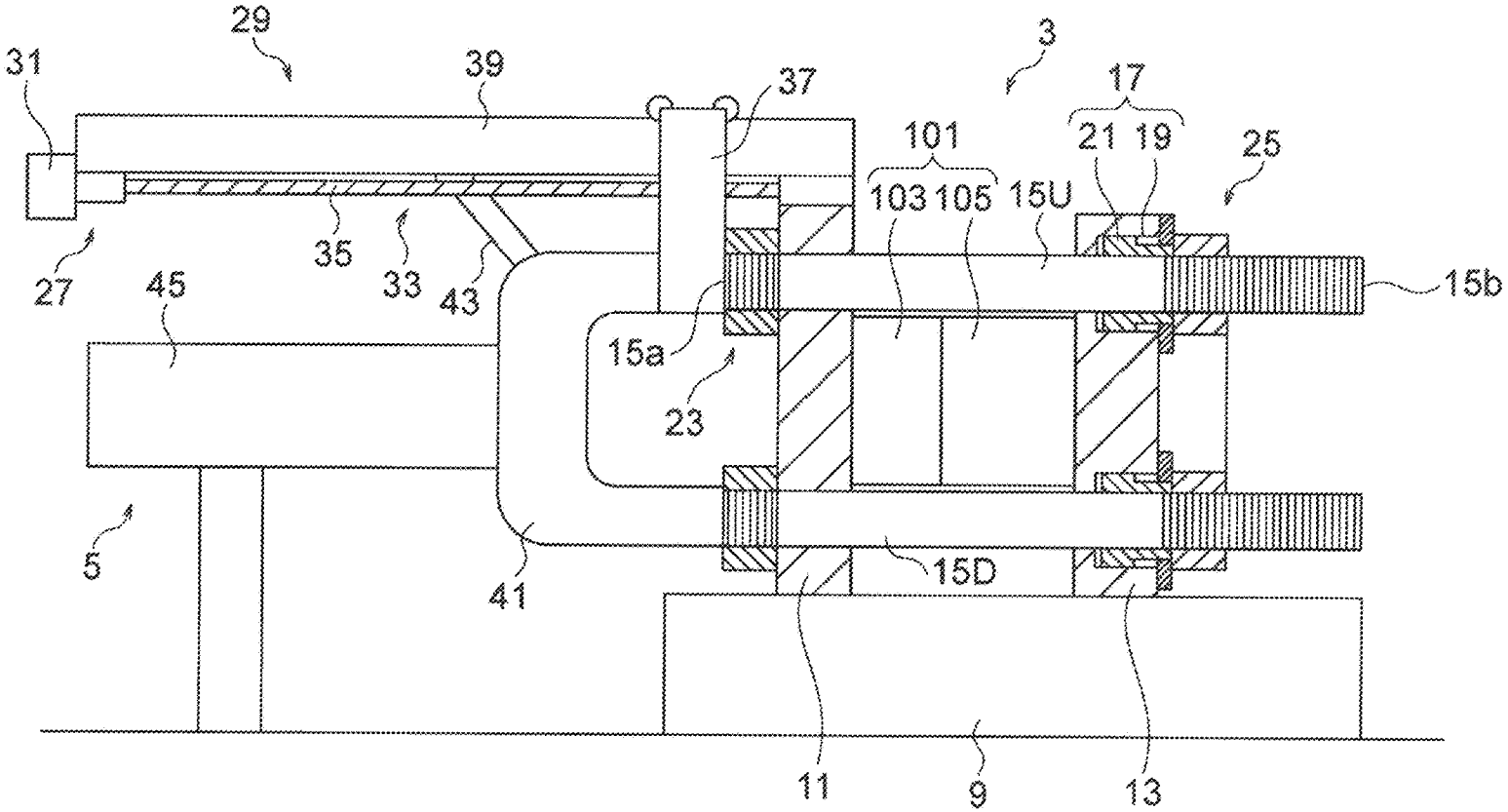
FIG. 2 is a schematic view showing the configuration of principal parts of the die casting machine in FIG. 1 in a mold closed state.
Figure 3:
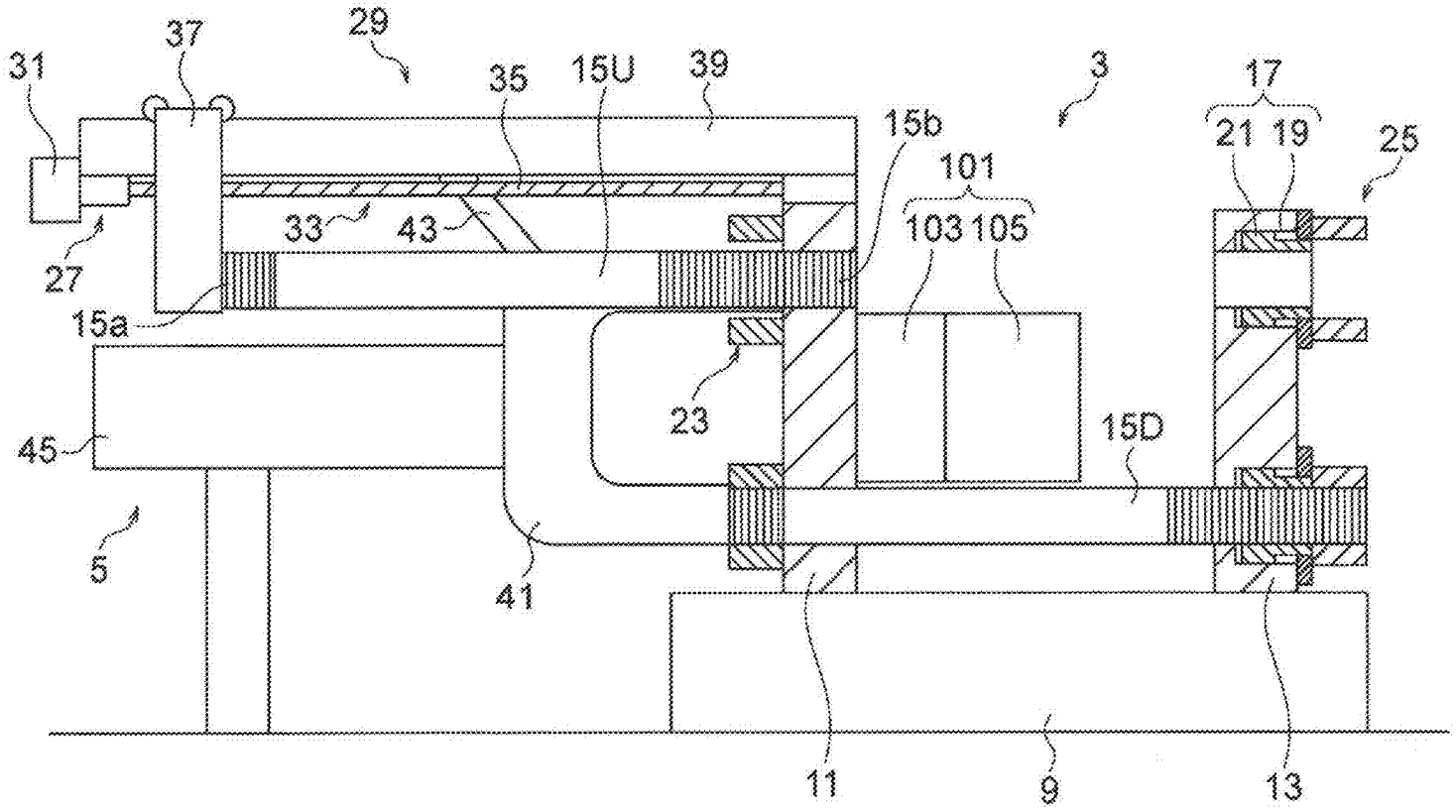
FIG. 3 is a schematic view showing the configuration of principal parts of the die casting machine in FIG. 1 in a tie bar pullout state.

All of FIG. 1 to FIG. 3 are side views, partially including cross-sectional views, of a die casting machine 1 according to a first embodiment. FIG. 1 shows a mold open state of the die casting machine 1. FIG. 2 shows a mold closed state of the die casting machine 1. FIG. 3 shows a tie bar pullout state of the die casting machine 1.

The die casting machine 1 is an apparatus for injecting a molten metal (an example of the molding material) to an internal part of a mold (die) 101 including a fixed mold (die) 103 and moving mold (die) 105, solidifying the molten metal, and thereby producing a die casting (an example of molded article).

The die casting machine 1 has for example a clamping device 3 which executes an mold opening and closing and mold clamping of the mold 101, an injection device 5 which injects a molten metal into the mold 101, a not shown ejection device which ejects the die casting from the fixed mold 103 or moving mold 105, and a control device 7 which controls these devices.

The clamping device 3, for example, has a base 9, a fixed platen 11 which is provided on the base 9 and holds the fixed mold 103, a moving platen 13 which is provided on the base 9 and holds the moving mold 105, and upper tie bars 15U and lower tie bars 15D (below, they will sometimes simply referred to as the "tie bars 15" and not be differentiated) which bridge the fixed platen 11 and the moving platen 13

The base 9 is for example placed on a surface of a factory floor. The fixed platen 11 and the moving platen 13 are arranged on the base 9 so as to face each other. The fixed platen 11 holds the fixed mold 103 on a mold attachment surface facing the moving platen 13 and is fixed with respect to the base 9. On the other hand, the moving platen 13 holds the moving mold 105 on the mold attachment surface facing the fixed platen 11 and is provided so that it can move in the mold opening and closing direction (direction approaching/separating from the fixed platen 11) relative to the base 9.

By movement of the moving platen 13 in a direction approaching the fixed platen 11 (mold closing direction), the mold 101 is closed (FIG. 2). Further, by the movement of the moving platen 13 in a direction separating from the fixed platen 11 (mold opening direction), the mold 101 is opened (FIG. 1).

The tie bars 15 are for example rod-shaped members which are made of metal and have circular cross-sections. A plurality of tie bars are provided around the mold 101. Specifically, for example, two upper tie bars 15U are provided at the positions which become the upper side relative to the mold 101, while two tie bars 15D are provided at the positions which become the lower side relative to the mold 101, i.e., four bars in total are provided. The four tie bars 15 are for example arranged so as to be symmetric at the top and bottom and symmetric at the right and left around the mold 101. The tie bars 15 have lengths at least long enough to bridge the fixed platen 11 and the moving platen 13 in the mold closed state.

In the mold closed state in FIG. 2, by fixing the end parts of the tie bars 15 on the fixed platen 11 side at the fixed platen 11 and pulling the end parts of the tie bars 15 on the moving platen 13 side to the back side of the moving platen 13 (the side opposite to the fixed platen 11, i.e., the right side on the sheet in the figure), the tie bars 15 can be made to extend and a clamping force in accordance with that extension amount can be generated.

The clamping device 3 is for example configured by a so-called composite type clamping device and separately has driving means for opening and closing the molds and driving means for clamping the molds. Specifically, the clamping device 3 for example has a not shown mold opening and closing drive device for opening and closing the molds and clamping cylinders 17 for clamping the molds.

The not shown mold opening and closing drive device is for example provided in the base 9. The mold opening and closing drive device may be a hydraulic type or may be an electrically operated type. A hydraulic type mold opening and closing drive device for example includes a hydraulic cylinder which is arranged having the mold opening and closing direction as the driving direction. The hydraulic cylinder for example has a cylinder part which is fixed to the base 9 and a piston rod which is fixed to the moving platen 13. Further, the electric operated type mold opening and closing drive device for example includes a ball-screw mechanism which is arranged with the mold opening and closing direction as the driving direction and a rotary electric motor which drives the ball-screw mechanism. The ball-screw mechanism for example has a screw shaft which is supported by the base 9 and a nut which is fixed to the moving platen 13. Further, the electric motor is used to rotate the screw shaft about its axis whereby the nut moves in the mold opening and closing direction.

Each clamping cylinder 17 for example has a cylinder part 19 which is built in the moving platen 13 and a clamping piston 21 which can slide in the cylinder part 19 in the mold opening and closing direction. Note that, it is also possible to connect the cylinder part 19 to the back side of the platen instead of building it in.

The clamping cylinders 17 are for example provided corresponding to the plurality of tie bars 15 in the same number as the tie bars 15. Further, the clamping pistons 21 have the tie bars 15 inserted in them. The clamping pistons 21, for example, although notations are not particularly attached, have piston bodies for partitioning the interiors of the cylinder parts 19 into two cylinder chambers and small diameter parts which project from the piston bodies to the back side of the moving platen 13 to be exposed to the outside of the cylinder parts 19.

In the mold closed state shown in FIG. 2, the end parts of the tie bars 15 on the fixed platen 11 sides are fixed with respect to the fixed platen 11, the tie bars 15 and the clamping pistons 21 are made to engage, and the clamping pistons 21 are made to move to the opposite side from the fixed platen 11 whereby the tie bars 15 can be pulled. In turn, the tie bars 15 are extended and a clamping force in accordance with the amount of extension thereof can be generated.

The tie bars 15 can be engaged with the fixed platen 11 in the mold opening and closing direction by the fixed side engagement devices 23. Further, that engagement can be released. In the same way, the tie bars 15 can be engaged with the clamping pistons 21 in the mold opening and closing direction by the moving side engagement devices 25. Further, that engagement can be released.

By that the tie bars 15 being able to engaged with the fixed platen 11 and with the clamping pistons 21, as explained above, the tie bars 15 can be pulled and the molds clamped. Further, by the engagement of the tie bars 15 and the clamping pistons 21 being able to be released, as shown in FIG. 1 and FIG. 2, the moving platen 13 can be made to move relative to the fixed platen 11 and the tie bars 15 and then the mold opening and closing can be executed. Further, by the engagement of the tie bars 15 with the fixed platen 11 and the clamping pistons 21 being able to be released, as shown in FIG. 3, the tie bars 15 can be pulled out.

Note that, in the present embodiment, the lower tie bars 15D are not pulled out from the moving platen 13. In such a case, the engagement of the lower tie bars 15D with respect to the fixed platen 11 in the mold opening and closing direction need not be able to be released. For example, in place of the fixed side engagement devices 23, bolts etc. may be used for the lower tie bars 15D to be fixed with respect to the fixed platen 11.

The fixed side engagement devices 23 for example have half nuts (notation omitted) which are supported so that they cannot move in the mold opening and closing direction with respect to the fixed platen 11 and not shown driving units (for example hydraulic cylinders) which drive the half nuts in an opening and closing direction thereof. On the other hand, at the end parts of the tie bars 15 on the fixed platen 11 sides, pluralities of grooves are formed at their outer circumferential surfaces, whereby fixed side engaged parts 15*a* are formed. Further, by meshing of the half nuts of the fixed side engagement devices 23 with the fixed side engaged parts 15*a* of the tie bars 15, the tie bars 15 and the fixed platen 11 are engaged in the mold opening and closing direction. Engagement is released by release of the meshing.

The moving side engagement devices 25 for example have half nuts (notation omitted) which are provided so that they cannot move in the mold opening and closing direction with respect to the clamping pistons 21 (so that they can move in the mold opening and closing direction together with the clamping pistons 21) and driving units (for example hydraulic cylinders) which can drive the half nuts in an opening and closing direction thereof. On the other hand, in the end parts of the tie bars 15 on the moving platen 13 sides, pluralities of grooves are formed at their outer circumferential surfaces, whereby moving side engaged parts 15*b* are formed. Further, by meshing of the half nuts of the moving side engagement devices 25 with the moving side engaged parts 15*b*, the tie bars 15 and the clamping pistons 21 are engaged in the mold opening and closing direction. Engagement is released by release of the meshing.

Note that, the relative positions of the fixed side engagement devices 23 and the fixed side engaged parts 15*a* in the mold opening and closing direction when the two mesh with each other are for example made constant without regard as to the thickness of the mold 101 (mold thickness, die height). Accordingly, the size of the fixed side engaged parts 15*a* in the mold opening and closing direction is for example made roughly equal to the size of the half nuts of the fixed side engagement devices 23 in the mold opening and closing direction.

On the other hand, the relative positions of the moving side engagement devices 25 and the moving side engaged parts 15*b* in the mold opening and closing direction when the two mesh with each other, as understood from FIG. 2, change according to the change of the mold thickness accompanied with exchange of the molds. Accordingly, the size of the moving side engaged parts 15*b* in the mold opening and closing direction is for example made larger than the size of the half nuts of the moving side engagement devices 25 in the mold opening and closing direction by an amount not less than the supposed amount of change the mold thickness. Further, the moving side engaged parts 15*b* are larger than the fixed side engaged parts 15*a* in the mold opening and closing direction.

The clamping device 3, for example, has pullout drive devices 27 which give a driving force for pullout to the upper tie bars 15U in order to pull out the upper tie bars 15U to the back side of the fixed platen 11, and support mechanisms 29 for supporting the loads of the upper tie bars 15U which are pulled out. One of the characteristic features of the present embodiment resides in provision of the support mechanisms 29.

The pullout drive devices 27 are for example electrically operated ones. Specifically, for example, the pullout drive devices 27 have rotary electric motors (driving units) 31 and screw mechanisms 33 which convert the rotation of the electric motors 31 to translational motion and transmit the same to the upper tie bars 15U.

The electric motors 31 may be DC motors or AC motors. Further, the electric motors 31 may be configured by induction motors or synchronous motors or other suitable motors. The electric motors 31 may be servo motors which configure servo mechanisms together with not shown encoders and servo drivers or may be ones controlled in an open loop. The electric motors 31 are for example supported by the support mechanisms 29 and are arranged away from the fixed platen 11 to the back side of the fixed platen 11.

The screw mechanisms 33 are for example configured by ball-screw mechanisms. The screw mechanisms 33 for example have screw shafts 35 which extend in the mold opening and closing direction and movable parts 37 which have female screw parts 53*a* (see FIG. 4A and FIG. 4B) which screw with the screw shafts 35 through not shown balls.

The screw shafts 35 for example extend parallel in the mold opening and closing direction. Further, they are generally completely positioned at the back side of the fixed platen 11 and are positioned above the upper tie bars 15U. The screw shafts 35 are for example directly or indirectly supported at the fixed platen 11. Specifically, for example, single ends of the screw shafts 35 on the fixed platen 11 sides are supported by support members (notation omitted) which are provided at the upper part of the fixed platen 11. Alternatively, for example, single ends of the screw shafts 35 which are separated from the fixed platen 11 to the back side thereof are supported by support mechanisms 29 provided at the upper part of the fixed platen 11 and by support members (notation omitted) which are provided at the support mechanisms 29. The screw shafts 35 are made unable to move in the axial direction but able to rotate about their axes.

The movable parts 37 are positioned behind the fixed platen 11, are made unable to rotate about the axes of the screw shafts 35, and are connected to the tie bars 15. Accordingly, when the electric motors 31 make the screw shafts 35 rotate about their axes, the movable parts 37 moves relative to the screw shaft 35 in the axial direction thereof (mold opening and closing direction) and in turn the tie bars 15 move relative to the fixed platen 11 in the mold opening and closing direction.

The support mechanisms 29, for example, have suspension beams 39 which extend above the upper tie bars 15U from the fixed platen 11 to the back side thereof and the already explained movable parts 37 which are suspended from the suspension beams 39 and suspend the upper tie bars 15U. Note that, the suspension beams 39 are basically provided separately from the pullout drive devices 27 (are not shared by the pullout drive devices 27). However, the movable parts 37 are shared by the support mechanisms 29 and the pullout drive devices 27.

The suspension beams 39 are for example positioned above the screw shafts 35. In other words, the screw shafts 35 are positioned in the up-down direction between the upper tie bars 15U and the suspension beams 39. The suspension beams 39 are for example supported at the fixed platen 11. More specifically, for example, the suspension beams 39 are fixed at single ends to the upper part of the fixed platen 11, so are supported upon the fixed platen 11 roughly like cantilevers. However, the suspension beams 39 may also be supported at their middle parts or the like at the fixed platen 11 through an injection frame 41 and a support member 43 which are supported by the injection frame 41.

The suspension beams 39 may be suitably set in their flexural rigidity etc. so that suitable suspension of the upper tie bars 15U (from another viewpoint, support of the load of the upper tie bars 15U) is possible in the process of pullout of the upper tie bars 15U and at the time of completion of pullout. For example, the suspension beams 39 preferably have amounts of deflection due to own weight thereof which are smaller than the amounts of displacement of the front ends of the upper tie bars 15U at the time of completion of pullout of the upper tie bars 15U due to the deflection due to own weight of the upper tie bars 15U (when assuming not suspended by the suspension beams 39) and looseness between the upper tie bars 15U and the fixed platen 11. Further, for example, the flexural rigidity of the suspension beams 39 is preferably higher than the flexural rigidity of the screw shafts 35.

The movable parts 37 are suspended from the suspension beams 39 so that they can move relative to the suspension beam 39 in the mold opening and closing direction. Accordingly, the upper tie bars 15U can move in the mold opening and closing direction in a state where they are suspended upon the suspension beams 39 through the movable parts 37. Note that, for the load which is added from the upper tie bars 15U to the movable parts 37, preferably all or most thereof is transmitted from the movable parts 37 to the suspension beam 39. However, a part thereof may be transmitted from the movable parts 37 to the screw shafts 35 as well.

The configuration of the injection device 5 may be similar to a known one. For example, the injection device 5 has a not shown injection sleeve which is communicated with the inside of the mold 101 from the back side of the fixed platen 11, a not shown injection plunger which is inserted into the injection sleeve from the back side (left side on the drawing sheets in FIG. 1 to FIG. 3) and can slide inside the injection sleeve in the front-back direction, and an injection cylinder 45 capable of driving the injection plunger in the front-back direction. The cylinder part (notation omitted) of the injection cylinder 45 is for example fixed to the injection frame 41. The piston rod (not shown) of the injection cylinder 45 is connected to the rear end of the injection plunger through a not shown coupling.

The control device 7 is, for example, though not particularly shown, configured by a computer including a CPU, ROM, RAM, external memory device, etc. The control device 5 controls operations of the clamping device 3, not shown injection device, not shown ejection device, and so on. For example, the control device 7 outputs control signals to drivers and/or hydraulic circuits (for example oil pressure circuits) of the drive devices of the above devices based on the information set in advance and signals of not shown sensors (position sensors or pressure sensors) etc.

The control device 7 has an input device 47 (FIG. 1) which accepts operations by a worker and a display device 49 (FIG. 1) which displays an image. The input device 47 and display device 49 may be integrally configured likewise a touch-panel type liquid crystal display device as well.

Figure 4A:
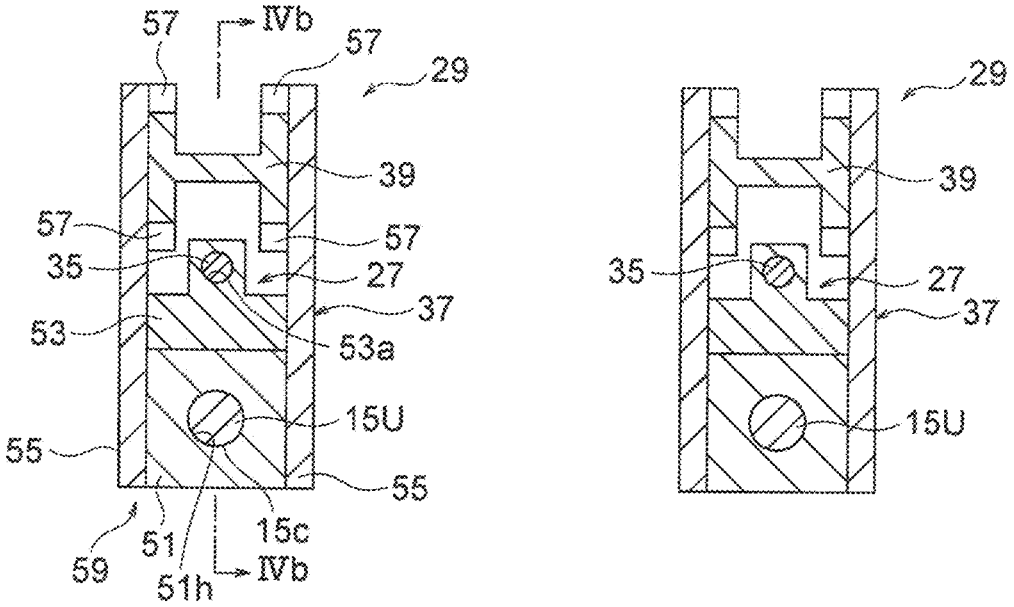
FIG. 4A is a cross-sectional view taken along a IVa-IVa line in FIG. 1.
Figure 4B:
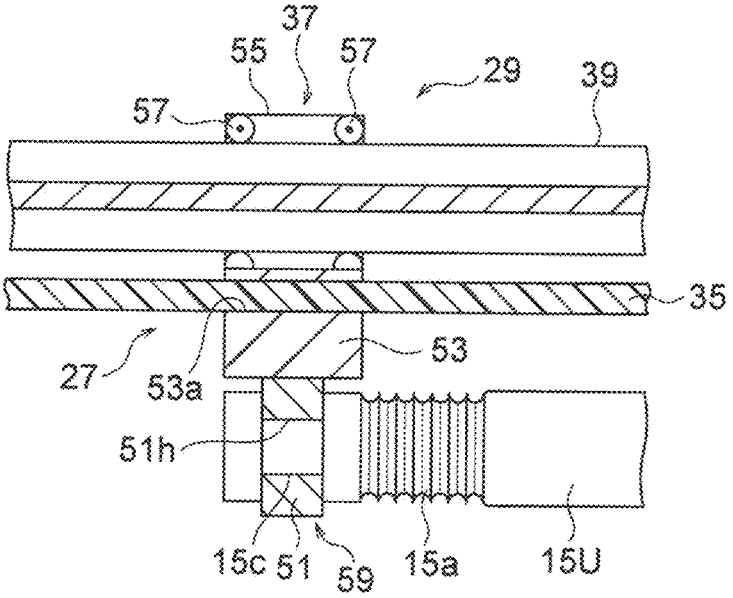
FIG. 4B is a cross-sectional view taken along a IVb-IVb line in FIG. 4A.

FIG. 4A is a cross-sectional view taken along a IVa-IVa line in FIG. 1. Further, FIG. 4B is a cross-sectional view taken along a IVb-IVb line in FIG. 4A.

As shown in FIG. 4A, in the present embodiment, a pullout drive device 27 and support mechanism 29 are provided for each of the two upper tie bars 15U, i.e., two sets in total are provided. The two sets of the pullout drive devices 27 and support mechanisms 29 are for example given the same configurations as each other.

Regarding each of the upper tie bars 15U, the upper tie bar 15U, the screw shaft 35 of the pullout drive device 27, and the suspension beam 39 of the support mechanism 29 are for example arranged on single line in the vertical direction (the positions in the left-right direction are the same as each other). The cross-sectional shapes of the suspension beams 39 may be made suitable shapes, but are for example H-types.

The movable parts 37 for example have coupling members 51 which are connected to the upper tie bars 15U, nuts 53 which are screwed with the screw shafts 35, hanging members 55 which suspend these from the suspension beams 39, and rolling members 57 which are interposed between the hanging members 55 and the suspension beams 39.

The coupling members 51 are for example members which have hole parts 51*h* (may be notches as well) running through them in the mold opening and closing direction. The diameters of the hole parts 51*h* are made smaller than the diameters (of the body parts) of the upper tie bars 15U. On the other hand, at the end parts of the upper tie bars 15U on the fixed platen 11 sides, for example, parts are formed with small diameters to thereby form the connected parts 15*c*. Further, by insertion of the small diameter parts of the connected parts 15*c* into the hole parts 51*h*, the coupling members 51 and the upper tie bars 15U are connected.

Specifically, the inner circumferential surface of the hole part 51*h* of the coupling member 51 abuts against the small diameter part of the connected part 15*c* in a radius direction including the vertical direction. Due to this, the coupling members 51 can support the loads of the upper tie bars 15U. Further, the two surfaces of the connected parts 15 which face the mold opening and closing direction are engaged with the recessed wall surfaces of the connected parts 15*c* in the mold opening and closing direction. Due to this, the coupling members 51 can give driving forces in the mold opening and closing direction to the upper tie bars 15U. The shapes of the hole parts 51*h* are for example circles. The cross-sectional shapes of the small diameter parts of the connected parts 15*c* are for example circles.

Note that, though not particularly shown, so that such connection becomes possible, the coupling members 51 may be for example configured by two or more members which are divided so as to divide the hole parts 51*h*, and these members may be connected to each other by screwing etc. so as to sandwich the connected parts 15*c* therebetween. Alternatively, in the upper tie bars 15U, the parts located closer to the end part sides than the small diameter parts of the connected parts 15*c* or the parts of the connected part 15*c* which extend from the small diameter parts to the end part sides are formed separately from the other parts of the upper tie bars 15U. After the small diameter parts of the connected parts 15*c* are inserted into the hole parts 51*h*, the parts may be fixed to other parts of the upper tie bars 15U by screwing etc.

The nuts 53 have female screw parts 53*a* with which the screw shafts 35 are screwed. The shapes and sizes of the nuts 53 may be suitable ones. Further, the nuts may be configured by two or more members as well.

For example, the hanging members 55 are plate-shaped members. In each of the movable parts, two hanging members 55 are provided. The two hanging members 55 are arranged to face each other so as to sandwich the coupling member 51 and nut 53 from the lateral two sides of the mold opening and closing direction and are fixed to these members. Further, the two hanging members 55 sandwich the suspension beam 39 from the lateral two sides of the mold opening and closing direction. Due to this, the upper tie bars 15U, screw shafts 35, and suspension beams 39 are arranged on lines in the vertical direction. Further, the sideward movements of the movable parts 37 with respect to the suspension beam 39 are restricted.

Note that the nuts 53 need only be able to give forces to the coupling members 51 in the mold opening and closing direction. Accordingly, for example, the nuts 53 may be provided so that they float relative to the coupling members 51 and hanging members 55 in the vertical direction as well. For example, the nuts 53 and the coupling members 51 (or hanging members 55) may be configured so that engagement parts and engaged parts which engage with each other in the mold opening and closing direction are provided and are not fixed to each other. By such configurations, the loads of the upper tie bars 15U which were applied to the coupling members 51 become harder to be transmitted from the coupling members 51 to the nuts 53 and screw shafts 35.

The rolling members 57 are for example wheels (disk shaped) which are made of metal. On the outer circumferential surfaces thereof, elastic members may be provided as well. The rolling members 57 are pivotally supported by the hanging members 55 so that they can roll on the surfaces of the suspension beams 39. More specifically, for example, four rolling members 57 which roll on the lateral two sides of the upper surfaces and lateral two sides of the lower surfaces of the suspension beams 39 are provided. By the rolling members 57 which roll on the upper surfaces of the suspension beams 39, the hanging members 55 are suspended from the suspension beam 39 so that they can move in the mold opening and closing direction. Further, by the rolling members 57 which roll on the lower surfaces of the suspension beams 39, rising of the hanging members 55 is suppressed.

Note that, in the movable parts 37, the coupling members 51, nuts 53, and hanging members 55 (or coupling members 51 and hanging members 55) configure the body members 59 which pivotally support the rolling members 57 and are connected to the upper tie bars 15U. The body members 59 may be suitably integrally formed or may be formed split. For example, the coupling members 51 and the nuts 53 may be integrally formed as well.

Further, the support members 43 shown in FIG. 1 to FIG. 3 are for example connected to the suspension beams 39 between the two hanging members 55 from the upper part and suspend the suspension beams 39.

Figure 5:
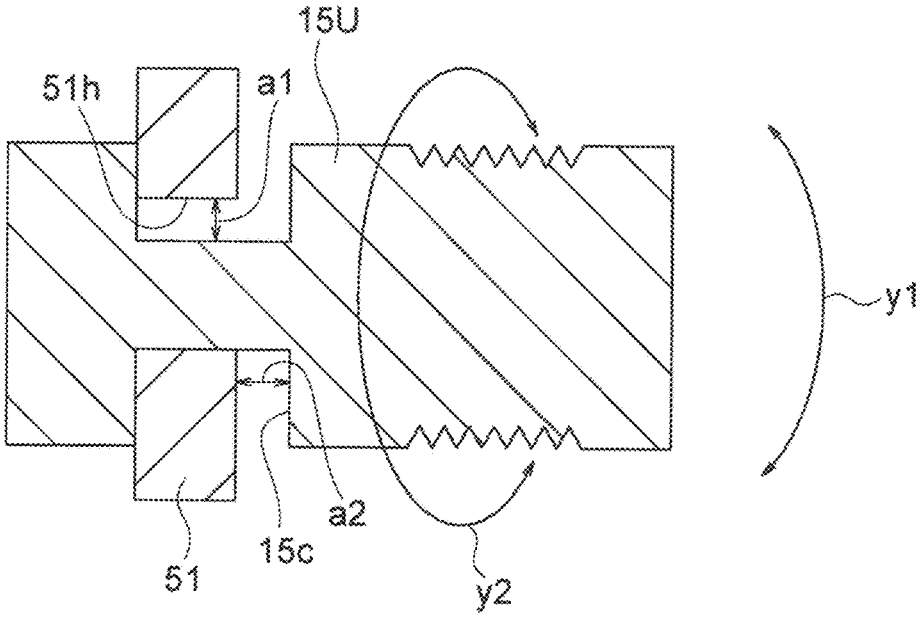
FIG. 5 is a cross-sectional view showing enlarged a coupling member of a movable part and a connected part of an upper tie bar.

FIG. 5 is a cross-sectional view showing enlarged the coupling members 51 of the movable parts 37 and the connected parts 15*c* of the upper tie bars 15U.

The coupling members 51 are connected with respect to the upper tie bars 15U so that they allow the inclination of the upper tie bars 15U relative to the coupling members 51 (inclination relative to the horizontal direction) indicated by an arrow y1.

Specifically, for example, the diameters of the hole parts 51*h* of the coupling members 51 are larger than the diameters of the small diameter parts of the connected parts 15*c*, therefore play a1 is generated in the diametrical directions of the upper tie bars 15U between the coupling members 51 and the upper tie bars 15U. Further, for example, the sizes of the recessed parts of the connected parts 15*c* in the mold opening and closing direction are larger than the thicknesses of the coupling members 51, therefore play a2 is generated in the mold opening and closing direction between the coupling members 51 and the upper tie bars 15U. Further, fixing the coupling members 51 and the upper tie bars 15U to each other by screwing etc. so that they cannot move relative to each other is not applied. By such a configuration, the inclinations of the upper tie bars 15U relative to the coupling members 51 are permitted. The dimensions of the plays a1 and a2 may be suitably set by considering the inclination angles etc. of the front ends of the upper tie bars 15U in the process of pullout of the upper tie bars 15U so that the action which will be explained later will be suitably exerted.

Further, the coupling members 51 are connected with respect to the upper tie bars 15U so as to allow rotation of the upper tie bars 15U about their axes relative to the coupling members 51 as indicated by an arrow y2.

Specifically, for example, the cross-sectional shapes of the small diameter parts of the connected parts 15*c* of the upper tie bars 15U are circular shapes, so the rotation positions of the connected parts 15*c* can be changed according to the sliding movement about the axes with respect to the inner circumferential surfaces of the hole parts 51*h*. Further, as already explained, fixing the coupling members 51 and the upper tie bars 15U to each other by screwing etc. so that they cannot move relative to each other is not applied. By such a configuration, the rotation of the upper tie bars 15U about their axes relative to the coupling members 51 is permitted.

Figure 6A:
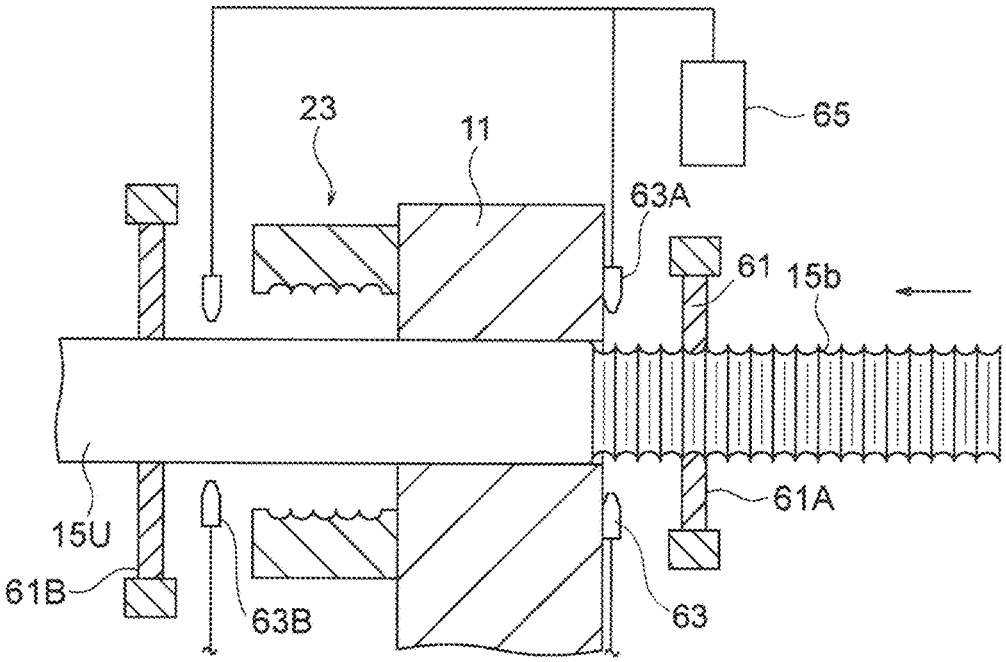
FIG. 6A is a cross-sectional view of the vicinity of a hole part of the fixed platen into which an upper tie bar is inserted.
Figure 6B:
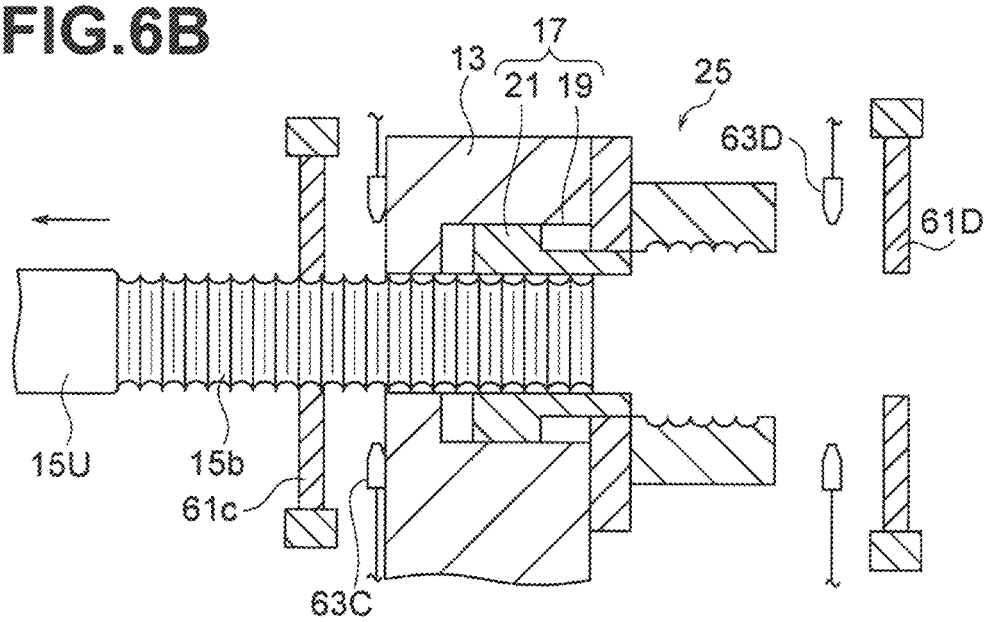
FIG. 6B is a cross-sectional view in the vicinity of a hole part of the moving platen into which the upper tie bar is inserted.

FIG. 6A is a cross-sectional view of the vicinity of a hole part of the fixed platen 11 into which an upper tie bar 15U is inserted. FIG. 6B is a cross-sectional view of the vicinity of a hole part of the moving platen 13 into which an upper tie bar 15U is inserted.

The clamping device 3, for example, has first scrapers 61A to fourth scrapers 61D (below, they will be sometimes simply referred to as the "scrapers 61" and not be differentiated) which abut against the upper tie bars 15U on the front side and back side of the fixed platen 11 and on the front side and back side of the moving platen 13 and has first nozzles 63A to fourth nozzles 63D (below, they will be sometimes simply referred to as the "nozzles 63" and not be differentiated) which can spray gas (for example air) toward the upper tie bars 15U.

The scrapers 61 are for example configured by spatulas made of elastic members or brushes made of metal. The scrapers 61 abut against the upper tie bars 15U and in turn, in the process of pullout of the upper tie bars 15U or the like, abut against the moving side engaged parts 15*b* and can remove foreign matter in grooves of the moving side engaged parts 15*b*. Note that, the first scrapers 61A which are provided on the back side of the fixed platen 11 can also contribute to the removal of the foreign matter of the fixed side engaged parts 15*a*.

For example, the scrapers 61 may be arranged in pluralities of units around the axes of the upper tie bars 15U or may be formed into ring shapes and have the upper tie bars 15U inserted into them. The first scrapers 61A and the second scrapers 61B which are positioned in front and back of the fixed platen 11 are for example supported by the fixed platen 11 through not shown suitable support members. The third scrapers 61C and the fourth scrapers 61D which are positioned in front and back of the moving platen 13 are for example supported upon the moving platen 13 through not shown suitable support members.

The nozzles 63 are for example connected to a gas feed part 65 (FIG. 6A). The gas feed part 65 is, though not particularly shown, configured by for example a gas pressure source such as a pump, an accumulator and/or a tank which stores compressed gas and a valve for controlling the feed of the gas from the gas pressure source. The nozzles 63 can feed the gas which is fed from the gas feed part 65 to the upper tie bars 15U. Due to this, in the process of pullout of the upper tie bars 15U etc., gas can be blown to the moving side engaged parts 15*b* to remove foreign matter in the grooves of the moving side engaged parts 15*b*. Note that, the first nozzles 63A which are provided on the back side of the fixed platen 11 can also contribute to the removal of the foreign matter at the fixed side engaged parts 15*a*.

The nozzles 63 may be arranged in pluralities of units around the axes of the upper tie bars 15U or may be configured by pipes which are formed in ring shapes, which have pluralities of holes and in which the upper tie bars 15U are inserted. The first nozzles 63A and the second nozzles 63B which are positioned at the front and back of the fixed platen 11 are for example supported at the fixed platen 11 through not shown suitable support members. The third nozzles 63C and the fourth nozzles 63D which are positioned at the front and back of the moving platen 13 are for example supported at the moving platen 13 through not shown suitable support members.

Note that, in FIG. 6A and FIG. 6B, the nozzles 63 are provided closer to the platen side than the scrapers 61. Accordingly, for example, the moving side engaged parts 15*b* are cleared of large foreign matter by the scrapers 61, then are cleared of the remaining foreign matter by gas sprayed from the nozzles 63, then are inserted into the platen. However, the positional relationships of the nozzles 63 and scrapers 61 relative to the platen may be reversed.

Further, the scrapers 61 and nozzles 63 were shown only for the tie bars to be pulled out (upper tie bars 15U). However, the scrapers 61 and nozzles 63 may also be provided for the tie bars not to be pulled out (lower tie bars 15D).

(Operation of Die Casting Machine)

The operation of the die casting machine 1 having the above configuration will be explained.

(Operation in Molding Cycle)

First, the operation of the die casting machine 1 in the molding cycle will be explained.

In the molding cycle, the tie bars 15 and the fixed platen 11 are engaged by the fixed side engagement devices 23. This state is maintained over a plurality of molding cycles.

At the time of start of the molding cycle, for example, as shown in FIG. 1, the die casting machine 1 is made the mold opened state. That is, the moving platen 13 is positioned at the mold opened position, and the fixed mold 103 and the moving mold 105 are separated. The half nuts of the moving side engagement devices 25 are opened, and the clamping pistons 21 and the tie bars 15 are not engaged with each other.

From the mold opened state in FIG. 1, the control device 7 outputs a control signal to a not shown mold opening and closing drive device so as to move the moving platen 13 in the closing direction. The moving platen 13 moves in the closing direction, whereby the moving mold 105 contacts (or approaches) the fixed mold 103 and the mold closed state is exhibited as shown in FIG. 2.

Next, the control device 7 outputs control signals to the moving side engagement devices 25 so as to close the half nuts of the moving side engagement devices 25. Due to this, the clamping pistons 21 and the tie bars 15 are engaged with each other.

Note that, the half nuts of the moving side engagement devices 25 and the moving side engaged parts 15*b* are adjusted in positions in the mold opening and closing direction (meshing adjustment is executed) within a range of less than 1 pitch of the grooves so that they mesh with each other (so that projections of one fit in the grooves of the other). The meshing adjustment may for example be performed by adjusting the positions of the tie bars 15 before the molding cycle so that meshing becomes possible when the moving mold 105 contacts the fixed mold 103, may be performed by adjusting the position of the moving platen 13 at the time of closing the molds, or may be performed by adjusting the positions of the clamping pistons 21 (and in turn the positions of the half nuts of the moving side engagement devices 25) at the time of closing the molds.

When the clamping pistons 21 and the tie bars 15 are engaged with each other, the control device 7 outputs a control signal to a not shown hydraulic circuit for controlling supply and discharge of hydraulic fluid with respect to the clamping cylinders 17 so that the clamping pistons 21 move to the side opposite to the fixed platen 11. Due to this, the tie bars 15 are pulled and extended, therefore a clamping force in accordance with the amount of extension is generated.

When the clamping force reaches a predetermined value and the molds finish being clamped, the control device 7 controls the injection device 5 so as to supply the molten metal into the mold 101. The molten metal injected into the mold 101 solidifies and becomes a die casting.

When the molten metal solidifies and the die casting is formed, the control device 7 releases the pressure from the clamping cylinders 17 to release the tension which has been applied to the tie bars 15 and eliminate the clamping force. Next, the control device 7 opens the half nuts of the moving side engagement devices 25 and releases the engagement of the clamping pistons 21 and the tie bars 15. Next, the control device 7 makes the moving platen 13 move to the mold opened position shown in FIG. 1. After that, preparations are made for the next cycle such as washing of the mold 101 or coating of a parting agent.

(Operation at Time of Changing Molds)

Next, the operation at the time of changing molds of the die casting machine 1 will be explained.

At the time of start of change of molds, for example, the die casting machine 1 is made to a state where the molding cycle ends, that is the mold opened state in FIG. 1. Then, the control device 7, for example, closes the molds up to contact in the same way as the closing operation in the molding cycle described above (FIG. 2) in accordance with an input operation etc. by the worker (operator).

After contact of the molds, for example, the worker etc. makes preparations for conveyance of the fixed mold 103 and the moving mold 105 in a state where they are assembled with each other. For example, the fixed mold 103 and the moving mold 105 are suspended together by a crane, and the fastened state of the fixed mold 103 and the fixed platen 11 and the fastened state of the moving mold 105 and the moving platen 13 are released. Note that, at this point of time, the fixed mold 103 may be left attached to the fixed platen 11.

When the work of suspending the fixed mold 103 and the moving mold 105 by the crane or the like ends, the control device 7 makes the moving platen 13 move up to the mold opened position in accordance with an input operation by the worker or the like.

Next, the control device 7, automatically or in accordance with an input operation etc. by the worker, controls the fixed side engagement devices 23 so as to release the engagement between the upper tie bars 15U and the fixed platen 11.

Next, the control device 7, automatically or in accordance with the input operation etc. by the worker, controls the electric motors 31 of the pullout drive devices 27 so as to make the upper tie bars 15U move to the back side of the fixed platen 11. Due to this, as shown in FIG. 3, the upper tie bars 15U are pulled out.

At this time, as shown in FIG. 3, the lower tie bars 15D may be engaged with the fixed platen 11 by the fixed side engagement devices 23 and may be engaged with the moving platen 13 by the moving side engagement devices 25. In this case, at the time of pullout of the upper tie bars 15U, the movement of the moving platen 13 is reliably restricted. However, the lower tie bars 15D may also be in a state where they are not engaged with the fixed platen 11 and/or moving platen 13.

After that, the mold 101 is carried out upward or sideward by the crane or the like. Further, new mold 101 is carried into a space between the fixed platen 11 and the moving platen 13 by the crane or the like.

After carrying the new mold 101 in, the control device 7 for example performs an operation reverse to that at the time of pullout of the tie bars. For example, the control device 7, in accordance with an input operation etc. by the worker, controls the pullout drive devices 27 so as to move the upper tie bars 15U to the front side of the fixed platen 11 (so as to insert the upper tie bars 15U). Next, the control device 7, automatically or in accordance with an input operation etc. by the worker, controls the fixed side engagement devices 23 so as to engage the upper tie bars 15U and the fixed platen 11 and makes the moving platen 13 move to the mold closed direction. Next, the worker fastens the fixed mold 103 to the fixed platen 11 and fastens the moving mold 105 to the moving platen 13. After that, the control device 7, in accordance with an input operation etc. by the worker, makes the moving platen 13 move to the mold opened position.

At the time of pullout and/or insertion of the upper tie bars 15U, the control device 7 judges presence/absence of an abnormality relating to the pullout and/or insertion of the upper tie bars 15U and makes the display device 49 display a predetermined warning when judging that there is an abnormality.

Specifically, for example, the control device 7 monitors the consumed powers of the electric motors 31 (that is, the loads) and judges that an abnormality has occurred when the consumed powers exceed a predetermined threshold value. Further, for example, the control device 7 judges whether the pullout or insertion has been completed within a predetermined time and judges that an abnormality has occurred in a case where the pullout or insertion is not completed within the predetermined time.

Note that, whether the pullout or insertion is completed may be judged based on for example detection values of not shown encoders of the electric motors 31 or the detection value of a not shown position sensor for detecting the position of the movable parts 37. The predetermined threshold value and predetermined time may be set by the manufacturer of the die casting machine 1 or may be set by a worker through the input device 47.

The warning which is displayed on the display device 49 may be a suitable image (including words). Further, in addition to or in place of the display of the warning on the display device 49, a predetermined sound may be output and/or the lit state of a predetermined lamp may be changed.

As described above, in the present embodiment, the clamping device 3 has the fixed platen 11, the moving platen 13 which is movable in the mold opening and closing direction relative to the fixed platen 11, the tie bars 15 which bridge the fixed platen 11 and the moving platen 13, the pullout drive devices 27 which give driving force making the upper tie bars 15U move to the back side of one platen (fixed platen 11 in the present embodiment) between the fixed platen 11 and the moving platen 13, the suspension beams 39 which are provided separately from the pullout drive devices 27 and extend to the back side of one platen (fixed platen 11) above the upper tie bars 15U, and the movable parts 37 which are suspended from the suspension beams 39 so that they can move in the mold opening and closing direction and suspend the upper tie bars 15U on the back side of one platen (fixed platen 11).

Accordingly, by the suspension beams 39, the loads of the upper tie bars 15U on the pullout direction side are supported. As a result, for example, the deflection of the upper tie bars 15U due to their weights, the inclination of the upper tie bars 15U due to looseness of the upper tie bars 15U and the fixed platen 11, the moments which act upon the fixed platen 11 from the upper tie bars 15U, and/or the friction forces between the upper tie bars 15U and the fixed platen 11 etc. are reduced. In turn, pullout and insertion of the upper tie bars 15U are smoothly carried out. Further, since the suspension beams 39 are provided separately from the pullout drive devices 27, by supporting the loads of the upper tie bars 15U by the suspension beams 39, the loads of the upper tie bars 15U which are applied to the pullout drive devices 27 are reduced or eliminated. As a result, for example, the operations of the pullout drive devices 27 are smoothened. Further, for example, the pullout drive devices 27 can be reduced in size and/or can be lowered in strength. Specifically, the strengths of the screw shafts 35 and the nuts 53 can be lowered.

Further, the upper tie bars 15U are pulled out to the back of the fixed platen 11, and the suspension beams 39 are fixed to the fixed platen 11.

Accordingly, for example, the suspension beams 39 are provided in a fixed manner for convenience. Further, for example, since they are provided at the fixed platen 11, in the mold opening and closing operation in the molding cycle, the suspension beams 39 will not cause the inertia of the moving platen 13 to increase unlike in an embodiment where they are provided at the moving platen 13 (this embodiment is also included in the invention of the present application). Further, for example, compared with an embodiment in which the suspension beams 39 provided at the fixed platen 11 are extended to the back of the moving platen 13 and the upper tie bars 15U are pulled out to the back of the moving platen 13 (this embodiment is also included in the invention of the present application), the suspension beams 39 may be made shorter. Further, for example, the back of the fixed platen 11 is the region in which the injection cylinders 45 etc. are arranged. The suspension beams 39 can be arranged above the injection cylinders 45 etc. Therefore the die casting machine 1 as a whole is reduced in size.

Further, in the present embodiment, the pullout drive devices 27 give driving forces in the mold opening and closing direction with respect to positions of the movable parts 37, the positions being between the suspension beams 39 and the upper tie bars 15U in the vertical direction.

Accordingly, for example, with respect to the driving forces from the pullout drive devices 27, resistances from the upper tie bars 15U and the suspension beams 39 which are caused by the inertia or frictional force are generated at the two sides in the vertical direction. As a result, for example, generation of unnecessary moments is suppressed. In turn, the pullout and/or insertion of the upper tie bars 15U is smoothly carried out. Further, depending on the configuration of the pullout drive devices 27, the suspension beams 39 also contribute to supporting the loads of the members of the pullout drive devices 27 (for example, the nuts 53), therefore the burdens on the pullout drive devices 27 are lightened.

Further, in the present embodiment, the pullout drive devices 27 have the screw shafts 35 which are parallel to the suspension beams 39, the movable parts 37 having the female screw parts 53*a* which are screwed with the screw shaft 35, and the electric motors 31 which generate driving forces making the screw shafts 35 rotate about their axes.

Accordingly, for example, compared with an embodiment in which the pullout drive devices are configured including hydraulic cylinders (this embodiment is also included in the invention of the present application), the speeds (acceleration and deceleration) of the upper tie bars 15U can be suitably controlled. For example, after starting driving of the upper tie bars 15U, the speed is gradually increased up to a predetermined speed, then, when the upper tie bars 15U reach the predetermined positions, the speed is reduced from the predetermined speed. Due to this, the time taken for the pullout and/or insertion can be shortened while preventing impact being given to the upper tie bars 15U. Further, for example, as already explained, the burdens on the screw shafts 35 are lightened by the suspension beams 39.

Further, in the present embodiment, the movable parts 37 have the body members 59 which are connected to the upper tie bars 15U and the rolling members 57 which are pivotally supported at the body members 59 so that they can roll on the upper surfaces of the suspension beams 39 in the mold opening and closing direction.

Accordingly, for example, compared with an embodiment in which the lower surfaces of the movable parts 37 slide relative to the upper surfaces of the suspension beams 39 (this embodiment is also included in the invention of the present application), the resistance when making the movable parts 37 move relative to the suspension beams 39 in the mold opening and closing direction becomes smaller. As a result, for example, the pullout and/or insertion of the upper tie bars 15U can be smoothly carried out, and also the burdens on the pullout drive devices 27 are lightened.

Further, in the present embodiment, the movable parts 37 are connected to the upper tie bars 15U so as to allow inclination of the upper tie bars 15U relative to the horizontal direction.

Accordingly, for example, the liability of damage to the movable parts 37 is reduced. Specifically, this is as follows. The upper tie bars 15U, when pulled out, change in the positions at which they are supported at the fixed platen 11 (and moving platen 13). Along with this, the states of deflection etc. of the upper tie bars 15U change. When assuming that the front ends of the upper tie bars 15U are not suspended from the suspension beams 39, along with the change of the states of deflection etc., the inclinations of the front ends of the upper tie bars 15U relative to the horizontal direction change. If the movable parts 37 and the suspension beams 39 are firmly fixed by screwing etc. (this embodiment is also included in the invention of the present application), the change of the inclinations is restricted by the movable parts 37, therefore large forces are liable to be applied to the movable parts 37 locally (for example to the threads). However, by connection of the movable parts 37 and the upper tie bars 15U so that the inclinations of the upper tie bars 15U relative to the horizontal direction can be allowed to a certain extent, the locally acting large forces are mitigated. In turn, the liability of damage to the movable parts 37 is reduced.

Further, in the present embodiment, the movable parts 37 is connected to the upper tie bars 15U so as to allow the rotation of the upper tie bars 15U about their axes.

Accordingly, for example, the liability of damage to the movable parts 37 is reduced. Specifically, this is as follows. When pulling the tie bars 15 by the clamping cylinders 17 and generating the clamping force, moments are applied to the tie bars 15 about their axes. The cause of this is not always clear, but a relatively large force is sometimes applied. Accordingly, if the movable parts 37 and the suspension beams 39 are firmly fixed by screwing etc. (this embodiment is also included in the invention of the present application), the moments end up being applied to the movable parts 37, therefore large forces are liable to be applied to the movable parts 37 locally (for example to the threads). However, by the connection of the movable parts 37 and the upper tie bars 15U so that the rotations of the upper tie bars 15U about their axes can be allowed to a certain extent, the locally acting large forces are mitigated. In turn, the liability of damage to the movable parts 37 is reduced.

Further, in the present embodiment, the clamping device 3 has split nut devices (moving side engagement devices 25)

which are provided at the other platen (moving platen 13) and can mesh with the moving side engaged parts 15*b* of the upper tie bars 15U and has the scrapers 61 which can abut against the moving side engaged parts 15*b*.

Accordingly, as already explained, foreign matter can be removed from the grooves of the moving side engaged parts 15*b*. As a result, for example, the moving side engaged parts 15*b* and the moving side engagement devices 25 suitably mesh. The foreign matter is deposited at the time of insertion into the platen or the like. Accordingly, from the viewpoint of suppressing the deposition of foreign matter with respect to the moving side engaged parts 15*b*, when pulling out the upper tie bars 15U to the back side of the fixed platen 11, preferably the moving side engaged parts 15*b* are not inserted into the fixed platen 11 (this embodiment is also included in the invention of the present application). On the other hand, if the moving side engaged parts 15*b* are positioned on the front side of the fixed platen 11 in the pullout completion state, they hinder work such as exchange of molds. In the present embodiment, however, the foreign matter of the moving side engaged parts 15*b* is removed by the scrapers 61. Therefore, even in the case where the upper tie bars 15U are pulled out up to the state where the moving side engaged parts 15*b* are inserted into the fixed platen 11, the moving side engaged parts 15*b* and the moving side engagement devices 25 suitably mesh. The effect is particularly effective, as in the present embodiment, in an embodiment in which the split nut devices (moving side engaged parts 15*b*) move relative to the platen (moving platen 13) in the mold opening and closing operation in the molding cycle. This is because, in such a case, as already explained, the moving side engaged parts 15*b* are formed relatively long in the mold opening and closing direction since their meshing positions with the moving side engagement devices 25 change according to the mold thickness.

Further, in the present embodiment, the clamping device 3 has the split nut devices (moving side engagement devices 25) which are provided on the other platen (moving platen 13) and can mesh with the moving side engaged parts 15*b* of the upper tie bars 15U and has the nozzles 63 capable of spraying gas toward the moving side engaged parts 15*b*.

Accordingly, as already explained, the foreign matter can be removed from the grooves of the moving side engaged parts 15*b*. As a result, for example, for the same reason as the scrapers 61, the pullout of the upper tie bars 15U and meshing of the moving side engaged parts 15*b* are suitably carried out.

Further, in the present embodiment, the clamping device 3 has the display device 49 and has the control device 7 which controls the pullout drive devices 27 and the display device 49. The control device 7 controls the display device 49 so as to display a predetermined warning at least at either of the time when the pullout or insertion of the upper tie bars 15U does not end within the predetermined time or the time when the loads of the pullout drive devices 27 exceed the predetermined threshold value at the time of pullout or insertion of the upper tie bars 15U.

Accordingly, for example, an abnormality such as galling in the sliding parts of the upper tie bars 15U and the fixed platen 11 can be informed to the worker. Due to this, for example, abnormality of the sliding parts of the upper tie bars 15U and/or fixed platen 11 is detected before the start of the molding cycle. This can be used for improving the operation of the molding cycle.

<Second Embodiment>

Figure 7:
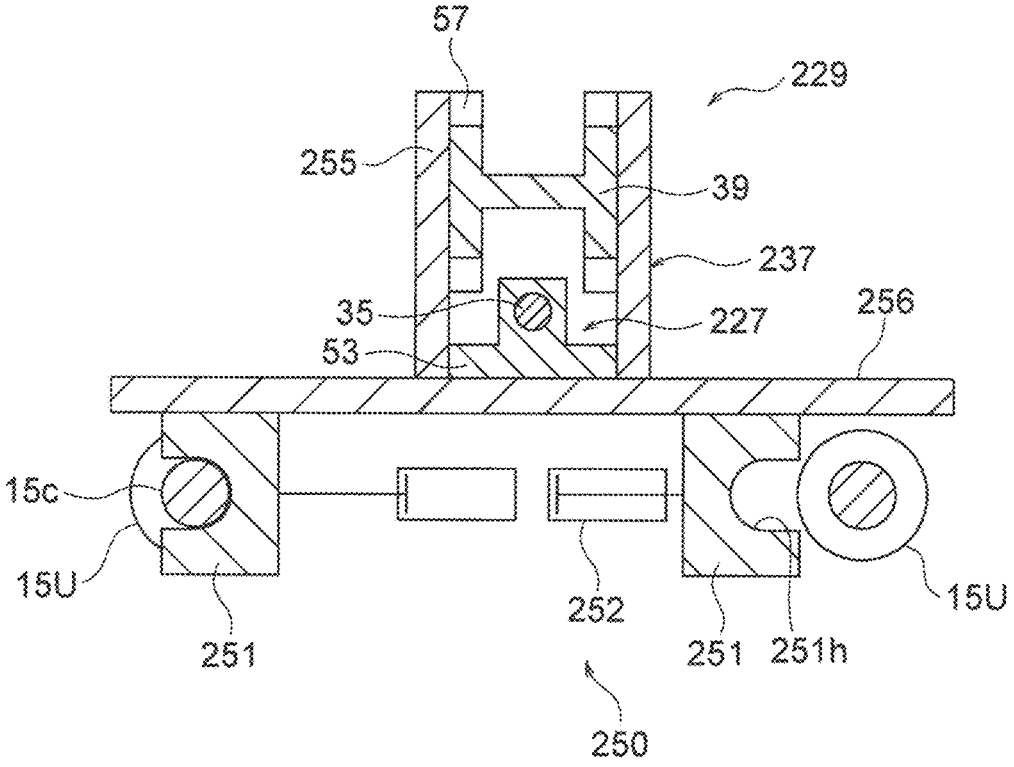
FIG. 7 is a cross-sectional view showing the configurations of a pullout drive device and a support mechanism according to a second embodiment of the present invention.

FIG. 7 is a cross-sectional view corresponding to FIG. 4A which shows the configurations of a pullout drive device 227 and a support mechanism 229 according to a second embodiment of the present invention.

In the first embodiment, a pullout drive device 27 and a support mechanism 29 were provided for each of the two upper tie bars 15U. Contrary to this, in the second embodiment, one pullout drive device 227 and support mechanism 229 are provided for the two upper tie bars 15U. Specifically, this is as follows.

The pullout drive device 227, for example, in the same way as the pullout drive devices 27 in the first embodiment, has an electric motor 31 (not shown in FIG. 7), a screw shaft 35 which is rotated about its axis by the electric motor 31, and a nut 53 (movable part 237) which is screwed with the screw shaft 35. However, the pullout drive device 227 is, as already explained, provided in common for the two upper tie bars 15U. The screw shaft 35 is, for example, positioned at the intermediate position between the two upper tie bars 15U in the left-right direction.

The support mechanism 229, for example, in the same way as the support mechanisms 29 in the first embodiment, has a suspension beam 39 and a movable part 237 which is suspended from the suspension beam 39 and suspends the upper tie bars 15U. Note, the support mechanism 227 is, as already explained, provided in common for the two upper tie bars 15U. The suspension beam 39 is, for example, positioned at the intermediate position between the two upper tie bars 15U in the left-right direction relative to the mold opening and closing direction.

The movable part 237, for example, in the same way as the movable parts 37 in the first embodiment, has coupling members 251 which are connected to the upper tie bars 15U, a nut 53 which is screwed with the screw shaft 35, hanging members 255 which suspend these from the suspension beam 39, and rolling members 57 which are interposed between the hanging members 255 and the suspension beam 39.

However, the movable part 237 is designed to able to be connected with respect to the two upper tie bars 15U. Specifically, for example, the movable part 237 has two coupling members 251 which can be connected to the two upper tie bars 15U and has a horizontal member 256 which connects these two coupling members 251 and the hanging members 255. By the movable part 237 being able to be connected with respect to the two upper tie bars 15U, it is possible to suspend the two upper tie bars 15U from one suspension beam 39 and it becomes possible to move the two upper tie bars 15U in the mold opening and closing direction by one pullout drive device 227.

Further, the movable part 237 is configured so that it not only can simultaneously pull out and/or insert the two upper tie bars 15U, but also can selectively pull out and/or insert each upper tie bar 15U. Specifically, this is as follows.

The coupling members 251 are for example members which have notches 251*h* into which the small diameter parts of the connected parts 15*c* of the upper tie bars 15U can be inserted. Accordingly, as shown in FIG. 7 which shows the states of the left and right coupling members 251 made different from each other, the coupling members 251 can insert and pull out the small diameter parts of the connected parts 15*c* into/from their notches 251*h*. That is, each coupling member 251 can move between a position at which it is connected to the connected part 15*c* and a position at which the connection is released.

The notches 251*h* are for example opened in the horizontal direction. The coupling members 251 are for example supported so that they can move in the left-right direction by hanging from a not shown rail provided on the horizontal member 256. At the position where each coupling member 251 is connected to the engaged part 15*c*, it is engaged with a connected part 15*c* in the mold opening and closing direction and supports the load of the connected part 15*c*.

Accordingly, by selectively connecting either of the two coupling members 251 to an upper tie bar 15U, either of the two upper tie bars 15U can be selectively pulled out and/or inserted. Further, by connecting both of the two coupling members 251 to the upper tie bars 15U, the two upper tie bars 15U can be simultaneously pulled out and/or inserted.

The movement of the two coupling members 251 between the connection positions and the positions at which the connections are released may be realized by suitable driving means and may be carried out by human power as well. FIG. 7 exemplifies a case where the coupling members 251 are driven by connection-use hydraulic cylinders 252.

Note that, the two coupling members 251 and two connection-use hydraulic cylinders 252 configure a connecting device 250 which can be selectively connected with respect to one, the other, or both of the two upper tie bars 15U.

As described above, the clamping device in the present embodiment, in the same way as the clamping device in the first embodiment, has the suspension beam 39 which is separately provided from the pullout drive device 227 and extends to the back side of one platen (fixed platen 11) above the upper tie bars 15U and has the movable part 237 which is suspended from the suspension beam 39 so that it can move in the mold opening and closing direction and suspends the upper tie bars 15U on the back side of one platen (fixed platen 11).

Accordingly, the same effects as those by the first embodiment are exhibited. For example, by supporting of the loads of the upper tie bars 15U by the suspension beam 39, the deflections of the upper tie bars 15U, inclinations of the upper tie bars 15U, moments which act upon the fixed platen 11 from the upper tie bars 15U, and/or the frictional force between the upper tie bars 15U and the fixed platen 11 etc. are reduced, therefore the pullout and insertion of the upper tie bars 15U are smoothly carried out. Further, for example, the operation of the pullout drive device 227 is smoothened, and the burden of the pullout drive device 227 for support of the loads is reduced as well.

Further, in the present embodiment, the clamping device has the two parallel upper tie bars 15U. The pullout drive device 227 has a connecting device 250 by which only one movable part 237 which is screwed with only one screw shaft 35 can be selectively connected with respect to one, the other, or both of the two upper tie bars 15U.

Accordingly, the pullout drive device 227 can be reduced in size. Further, depending on the worker of the die casting machine 1, sometimes the upper tie bars 15U are pulled out one by one in the work procedure. Even this case can be handled.

Note that, unlike the present embodiment, only one movable part which is screwed with only one screw shaft 35 may be constantly connected to the two upper tie bars 15U as well. That is, only one pullout drive device and only one support mechanism may be capable of pulling out and/or inserting the two upper tie bars 15U only at the same time.

<Third Embodiment>

Figure 8:
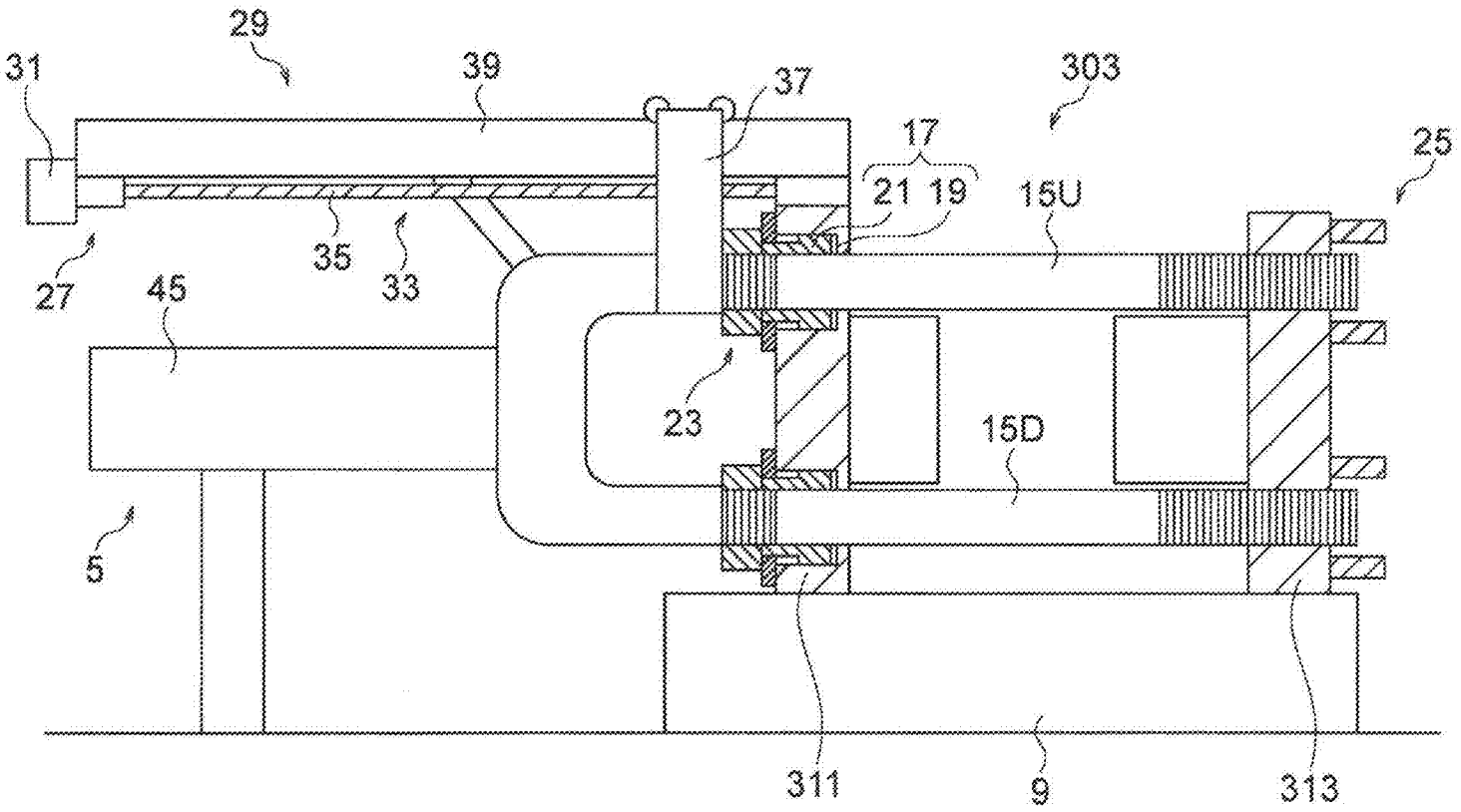
FIG. 8 is a schematic view showing the configuration of principal parts of a die casting machine according to a third embodiment of the present invention in a mold open state.

FIG. 8 is a schematic view showing the configuration of the principal parts of a die casting machine 301 (clamping device 303) according to a third embodiment in an mold opened state.

The clamping device 303 differs from the first embodiment in the point that the clamping cylinders 17 are provided not at the moving platen 313, but at the fixed platen 311. Further, along with the difference, the moving side engagement devices 25 engage with the moving platen 313 in the mold opening and closing direction, and the fixed side engagement devices 23 engage with the clamping pistons 21 in the mold opening and closing direction. Other than those, the configuration of the clamping device 303 is similar to the configuration of the clamping device 3 in the first embodiment. The operation thereof is generally the same as the operation of the clamping device 3 as well.

Note that, in the above embodiments, the die casting machines 1 and 301 are examples of the molding apparatus, the fixed platen 11 is one example of one platen, and the moving platen 13 is one example of the other platen. Further, the suspension beams 39 are one example of one example of the suspension members.

The present invention is not limited to the above embodiments and may be worked in various forms.

The molding machine (molding apparatus) is not limited to a die casting machine. For example, the molding machine may be another metal molding machine, may be an injection molding machine for molding a resin, and may be a molding machine for molding a material obtained by mixing a thermoplastic resin or the like with sawdust. Further, the molding machine is not limited to horizontal injection. For example, it may be vertical injection type as well.

The fundamental configuration of the clamping device (opening and closing apparatus) is not limited to those exemplified in the embodiments. For example, either or all of the mold opening and closing, mold clamping, and injection may be suitably electrically driven. Further, for example, the tie bars may be made fixed relative to the moving platen in the molding cycle and may moved relative to the fixed platen in the mold opening and closing operation. Further, for example, the platen to which the tie bars are fixed over a plurality of molding cycles and the platen to the back of which the tie bars are moved at the time of pullout of the tie bars may be platens different from each other. Also, the combination of the relationships between the tie bars and the platens and the relationships between the clamping cylinders and the platens may be suitably changed. Further, for example, in the mold opened state of the molding cycle, the tie bars may be pulled out from the other platen (moving platen 13 in the embodiments) as well.

In the first embodiment, a pullout drive device and a suspension beam were provided for each tie bar, while in the second embodiment, one pullout drive device and one suspension beam were provided for a plurality of (two) tie bars. However, a suspension beam may be provided for each tie bar and one pullout drive device may be provided for a plurality of tie bars. Alternatively, one suspension beam may be provided for a plurality of tie bars and a pullout drive device may be provided for each tie bar. Further, the number of tie bars to be pulled out is not limited to the upper two. For example, all tie bars may be pulled out as well. In the embodiments, the movable parts were shared by the pullout drive devices and the support mechanisms, but need not be shared.

The pullout drive devices are not limited to electrically operated types and may be for example hydraulic types as well. For example, the pullout drive devices may be configured including pullout cylinders which are arranged parallel to the mold opening and closing direction as well. Further, in a case where the pullout drive devices are electrically operated types, the pullout drive devices are not limited to ones including screw mechanisms. For example, the pullout drive devices may be configured including chains or other winding mechanisms, may be configured including rack and pinion mechanisms, or may be configured including linear motors.

As shown in the second embodiment, the pullout drive devices and/or support mechanisms need not be always connected to the tie bars. They may also be connected to the tie bars only at the time when there is a necessity of pullout. The connection and the release thereof may be carried out by the driving means or may be carried out by human power as described in the explanation of the second embodiment. Further, the connection is not limited to one achieved by the movement of the coupling members in which notches are formed. For example, it may be carried out by split nut devices, carried out by screws, or carried out by attraction by magnetic force.

From the description of the present application, the following inventions which do not have suspension beams and pullout drive devices (pullout of tie bars) as necessary matters may be extracted.

(Other Invention 1)

A clamping device having:

a fixed platen, a moving platen movable in an mold opening and closing direction relative to the fixed platen, a tie bar bridging the fixed platen and the moving platen, a split nut device which is provided on one platen of the fixed platen and the moving platen and can mesh with an engaged part provided on the tie bar, and a scraper which can abut against the engaged part.

(Other Invention 2)

A clamping device having:

a fixed platen, a moving platen movable in an mold opening and closing direction relative to the fixed platen, a tie bar bridging the fixed platen and the moving platen, a split nut device which is provided at one platen of the fixed platen and the moving platen and can mesh with engaged part provided at the tie bar, and a nozzle which can spray gas toward the engaged parts.

Priority is claimed on Japanese application No. 2014-262783, filed on Dec. 25, 2014, the content of which is incorporated herein by reference.

Note that, in the above other inventions, where the tie bars are pulled out, the "one platen" may be a platen to the back of which the tie bars are pulled out or may be a platen to the front of which the tie bars are pulled out.

REFERENCE SIGNS LIST

1 . . . die casting machine, 3 . . . clamping device, 11 . . . fixed platen, 13 . . . moving platen, 15 . . . upper tie bar (tie bar), 27 . . . pullout drive device, 37 . . . movable part, and 39 . . . suspension beam.

The invention claimed is:

1. A clamping device comprising:

a fixed platen, a moving platen movable in a mold opening and closing direction relative to said fixed platen, a tie bar which bridges said fixed platen and said moving platen, a pullout drive device which generates a driving force in the mold opening and closing direction, a support mechanism which is fixed relative to one of the fixed platen and the movable platen and provided separately from said pullout drive device and a mold opening and closing drive device, and a movable part movably coupled to the support mechanism and coupled to the tie bar so that the support mechanism supports a load of the tie bar through the movable part when the tie bar moves, and transmits the driving force from the pullout drive device to the tie bar in a direction parallel thereto to make said tie bar move to a back side of one platen of said fixed platen and said moving platen until the tie bar is pulled out from the other platen of said fixed platen and said moving platen, the pullout drive device being provided separately from a mold opening and closing drive device moving the moving platen to open and close molds.

2. The clamping device according to claim 1, wherein:

said support mechanism has a suspension member which is provided separately from said pullout drive device and extends above said tie bar to the back side of said one platen, and the movable part is suspended from said suspension member so as to be movable in the mold opening and closing direction and suspends said tie bar at the back side of said one platen.

3. The clamping device according to claim 2, wherein said one platen is said fixed platen, and said suspension member is supported upon said fixed platen.

4. The clamping device according to claim 2, wherein said pullout drive device gives the driving force in the mold opening and closing direction to a position of said movable part, the position being between said suspension member and said tie bar in an up-down direction.

5. The clamping device according to claim 2, comprising two parallel tie bars, wherein said movable part has a connecting device which is selectively connected with respect to one, the other, and both of the two tie bars.

6. The clamping device according to claim 1, further comprising:

a display device and a control device for controlling said pullout drive device and said display device, wherein said control device controls said display device so as to display an abnormality in a predetermined manner at least at one of a time when the pullout or insertion of said tie bar does not end within a predetermined time and a time when a load of said pullout drive device exceeds a predetermined threshold value at the time of pullout or insertion of said tie bar.

7. A molding apparatus comprising a clamping device of claim 1.

8. The clamping device according to claim 1, wherein the movable part is shared by the support mechanism and the pullout drive device.

9. A clamping device comprising:

a fixed platen, a moving platen movable in a mold opening and closing direction relative to said fixed platen, a tie bar which bridges said fixed platen and said moving platen, a pullout drive device which gives to said tie bar a driving force in the mold opening and closing direction which makes said tie bar move to a back side of one platen of said fixed platen and said moving platen, and a support mechanism which is provided separately from said pullout drive device and supports a load of said tie bar when the tie bar moves;

wherein said support mechanism has:

a suspension member which is provided separately from said pullout drive device and extends above said tie bar to the back side of said one platen and a movable part which is suspended from said suspension member so as to be movable in the mold opening and closing direction and suspends said tie bar at the back side of said one platen; and wherein said movable part has a body member which is connected to said tie bar and a rolling member which is pivotally supported by said body member to be able to roll in the mold opening and closing direction on the upper surface of said suspension member.

10. A clamping device comprising:

a fixed platen, a moving platen movable in a mold opening and closing direction relative to said fixed platen, a tie bar which bridges said fixed platen and said moving platen, a pullout drive device which gives to said tie bar a driving force in the mold opening and closing direction which makes said tie bar move to a back side of one platen of said fixed platen and said moving platen, a support mechanism which is provided separately from said pullout drive device and supports a load of said tie bar when the tie bar moves, a split nut device which is provided at the other platen of said fixed platen and said moving platen and meshes with an engaged part provided at said tie bar, and a scraper which abuts against said engaged part.

11. A clamping device comprising:

a fixed platen, a moving platen movable in a mold opening and closing direction relative to said fixed platen, a tie bar which bridges said fixed platen and said moving platen, a pullout drive device which gives to said tie bar a driving force in the mold opening and closing direction which makes said tie bar move to a back side of one platen of said fixed platen and said moving platen, and a support mechanism which is provided separately from said pullout drive device and supports a load of said tie bar when the tie bar moves, a split nut device which is provided at the other platen of said fixed platen and said moving platen and meshes with an engaged part provided at said tie bar, and a nozzle which is capable of spraying gas toward said engaged part.

* * * * *